US010463894B2

(12) United States Patent
Gray

(10) Patent No.: US 10,463,894 B2
(45) Date of Patent: Nov. 5, 2019

(54) HYDRATION RESPIRATION APPARATUS

(71) Applicant: Matthew P. Gray, Topeka, KS (US)

(72) Inventor: Matthew P. Gray, Topeka, KS (US)

( * ) Notice: Subject to any disclaimer, the term of this patent is extended or adjusted under 35 U.S.C. 154(b) by 1126 days.

(21) Appl. No.: 14/810,072

(22) Filed: Jul. 27, 2015

(65) Prior Publication Data

US 2017/0028229 A1 Feb. 2, 2017

(51) Int. Cl.

| | |
|---|---|
| ***A62B 18/08*** | (2006.01) |
| ***A62B 7/10*** | (2006.01) |
| ***A62B 18/02*** | (2006.01) |

(52) U.S. Cl.

CPC ..... *A62B 18/086* (2013.01); *A62B 7/10* (2013.01); *A62B 18/025* (2013.01)

(58) Field of Classification Search

CPC . A62B 18/086; A45F 2003/166; A42B 3/048; B67D 2210/00131; B67D 1/0004; A41D 2400/46

See application file for complete search history.

(56) References Cited

U.S. PATENT DOCUMENTS 1,366,437 A * 1/1921 Wagenhorst ..... A62B 18/086 128/202.15
3,635,217 A * 1/1972 Potash ..... A62B 18/086 128/201.19
4,823,785 A * 4/1989 Mancosu ..... A62B 18/086 128/202.15
5,301,858 A * 4/1994 Hollander ..... B62J 11/00 224/148.2
5,595,325 A * 1/1997 Leres ..... B67D 3/00 222/135
6,446,628 B1 * 9/2002 Chen ..... A45F 3/20 128/200.24
6,615,829 B2 9/2003 Horn et al.
6,758,213 B1 * 7/2004 Brekken ..... B63C 11/02 128/202.15
7,296,568 B2 11/2007 Capon et al.
7,810,493 B2 * 10/2010 Resnick ..... A62B 18/086 128/201.28
7,856,976 B2 * 12/2010 Mueller ..... A62B 18/086 128/201.22
8,640,693 B2 * 2/2014 Low ..... A62B 18/086 128/201.26

(Continued)

*Primary Examiner* — Bradley H Philips
*Assistant Examiner* — Victoria Murphy
(74) *Attorney, Agent, or Firm* — Dale J. Ream

(57) ABSTRACT

A hydration respiration apparatus includes a respirator assembly having a facemask that covers the nose and mouth of user and a pair of filter cartridges on opposed sides of the facemask. A hydration assembly includes a hydration tube extending through a front wall of the facemask and a hydration reservoir configured to hold a liquid, the reservoir being displaced from the respirator assembly and in fluid communication with the tube. The hydration tube includes a proximal end situated in the interior area of the facemask and a distal end situated outside the facemask, the tube being selectively movable between a retracted configuration substantially outside the interior area and a deployed configuration substantially inside the interior area. The proximal end of the hydration tube includes a valve configured to selectively release water into the mouth of the user when the hydration tube is at the deployed configuration.

21 Claims, 11 Drawing Sheets

(56) References Cited

U.S. PATENT DOCUMENTS

| | | | | |
|---|---|---|---|---|
| D771,801 | S * | 11/2016 | Gray | D24/108 |
| 2002/0022808 | A1 | 2/2002 | Horn et al. | |
| 2003/0168470 | A1* | 9/2003 | Choi | A45F 3/20 222/14 |
| 2004/0079775 | A1* | 4/2004 | Choi | A45F 3/20 224/148.2 |
| 2004/0089301 | A1* | 5/2004 | Choi | A45F 3/06 128/203.29 |
| 2005/0241641 | A1* | 11/2005 | Fletcher | A62B 18/086 128/205.22 |
| 2006/0090755 | A1* | 5/2006 | King | A62B 18/086 128/202.15 |
| 2006/0180154 | A1 | 8/2006 | Stone | |
| 2008/0011295 | A1* | 1/2008 | Mueller | A62B 18/086 128/202.15 |
| 2009/0084385 | A1* | 4/2009 | Lang | A61M 16/0463 128/206.21 |
| 2010/0065584 | A1* | 3/2010 | Berger | A45F 3/04 222/145.5 |
| 2012/0103327 | A1* | 5/2012 | Low | A62B 18/086 128/202.15 |
| 2012/0247474 | A1* | 10/2012 | Torbenson | A62B 18/02 128/206.15 |
| 2017/0028229 | A1* | 2/2017 | Gray | A62B 18/086 |
| 2018/0271114 | A1* | 9/2018 | Cocchi | A23G 9/228 |
| 2018/0280758 | A1* | 10/2018 | Tao | A63B 23/18 |

* cited by examiner

HYDRATION RESPIRATION APPARATUS

BACKGROUND OF THE INVENTION

This invention relates generally to breathing masks and hydration packs and, more particularly, to a hydration respiration apparatus that enables a laborer (such as a commercial painter) wearing a respiration mask to maintain suitable personal hydration without having to stop working or remove the respiration equipment.

Workers who breathe an excessive amount of dust, fumes, smoke, gases, vapors, or mists may be at risk for work-related lung disease. Specifically, painters face health risks caused by the overspray from spray painting. This is especially true for commercial painters and auto-body painters. For instance, car paint contains isocyanates which are particularly unhealthy to breathe. Similarly, commercial painters may spray paint for hours or days in a large warehouse or factory having very little or simply inadequate ventilation.

As a result, painters often wear a respirator having filters designed to collect or block the contaminants from paint overspray. When painting for hours on end, the painter often needs to stop painting in order to drink water and hydrate himself, especially when painting inside of a hot building, such as factory, industrial plant, or new construction that does not have a controlled temperature.

Various devices and patent proposals are known in the prior art for respiration masks that make it easier for a worker to have food or beverages in close proximity. Although presumably effective for their intended purposes, the existing devices do not enable a worker to quickly and easily receive a drink of water without first having to remove the respirator mask and, as a result, stop working for an undesirably long period of time.

Therefore, it would be desirable to have a hydration respiration apparatus having a respirator assembly for blocking or collecting impurities in the area from being inhaled by a user and having a hydration assembly that channels water to a user's mouth for hydration. Further, it would be desirable to have a hydration respiration apparatus having a mask with filters that is wearable by a worker and a hydration reservoir wearable on the back of the user that delivers water to an insertion tube in the mask in selective fluid communication to a user's mouth. In addition, it would be desirable to have a hydration respiration apparatus in which the insertion tube is selectively movable between a retracted configuration displaced from a wearer's mouth and a deployed configuration proximate a wearer's mouth such that a user obtains a drink by biting the tip of the insertion tube.

SUMMARY OF THE INVENTION

A hydration respiration apparatus for providing clean air and water to a user according to the present invention includes a respirator assembly that includes a facemask having a front surface and defining an interior area, the facemask configured to cover at least the nose and mouth of user and having a pair of filter cartridges situated on opposed sides of the facemask in communication with the interior area. A hydration assembly includes a tube that extends through a front wall of the facemask and a hydration reservoir that is configured to hold a liquid, the hydration reservoir being displaced from the respirator assembly and in fluid communication with the hydration tube. The hydration tube includes a proximal end normally situated in the interior area of the facemask and a distal end is situated outside the facemask, the hydration tube being selectively movable between a retracted configuration substantially outside the interior area and a deployed configuration substantially inside the interior area.

The proximal end of the hydration tube includes a bite valve that is configured to selectively allow liquid to pass therethrough when the hydration tube is at the deployed configuration and the user bites on the bite valve. The hydration assembly includes an actuator operatively coupled to the front wall of the facemask and coupled to the hydration tube, the actuator being configured to selectively move the hydration tube between the retracted and deployed configurations.

Therefore, a general object of this invention is to provide a hydration respiration apparatus having a respiration assembly having a facemask and a hydration assembly having a hydration tube that selectively channels water to the mouth of a wearer of the facemask.

Another object of this invention is to provide a hydration respiration apparatus, as aforesaid, in which the hydration tube is selectively movable between a retracted configuration substantially outside of an interior area of the facemask and a deployed configuration substantially inside of the interior area such that a user may bite on a bite valve and receive a quantity of liquid.

Still another object of this invention is to provide a hydration respiration apparatus, as aforesaid, in which the hydration assembly includes a hydration reservoir coupled to a backpack to be worn on the back of a user, the hydration reservoir containing a quantity of water and including a supply hose in fluid communication with the hydration tube positioned in the facemask.

Yet another object of this invention is to provide a hydration respiration apparatus, as aforesaid, in which the backpack includes front straps configured to be worn over a user's shoulders and having a safety vest portion with reflective strips.

A further object of this invention is to provide a hydration respiration apparatus, as aforesaid, in which the hydration tube is movable by operation of a user's hand without removal of the facemask.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
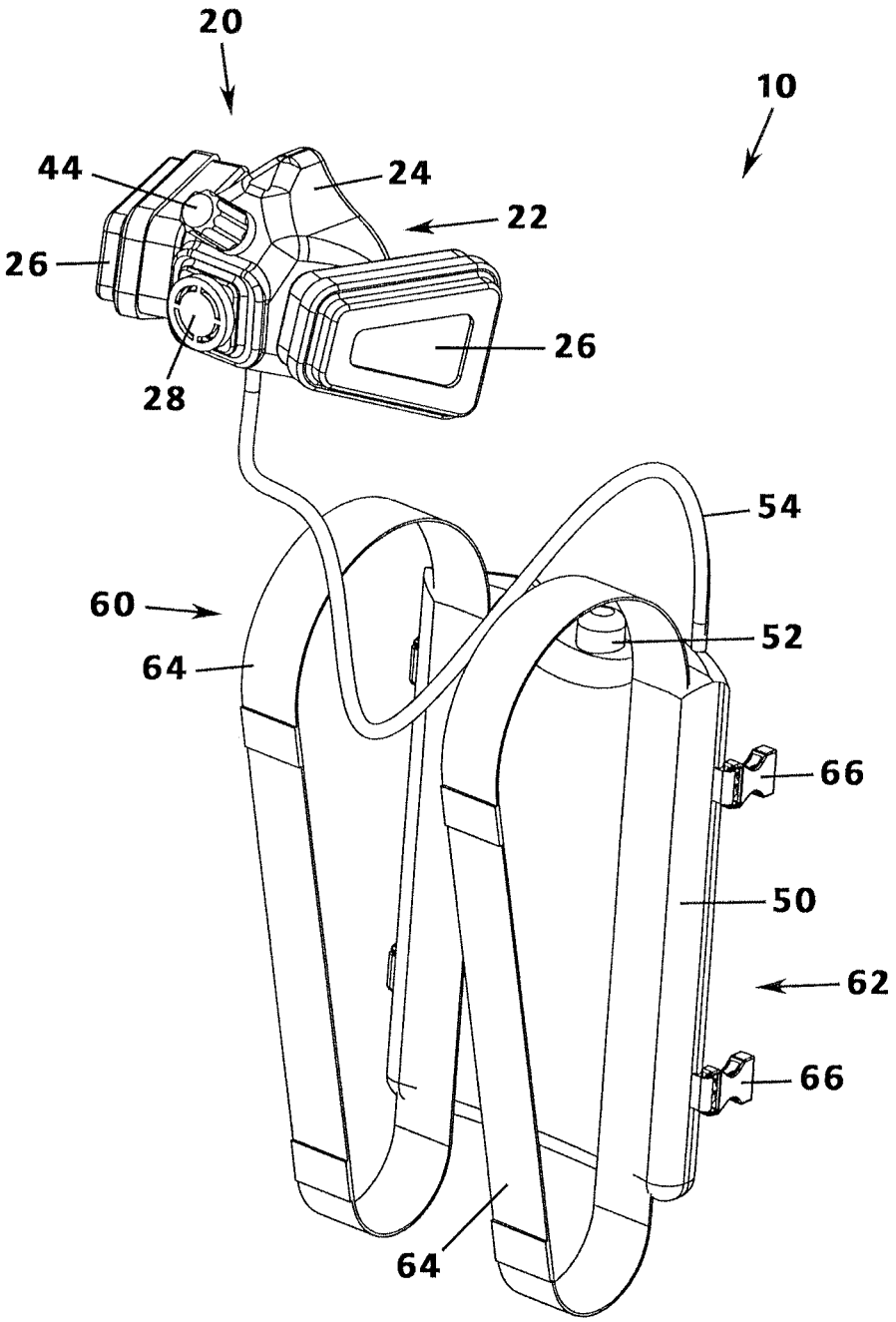
FIG. 1*a* is a perspective view of a hydration respiration apparatus according to a preferred embodiment of the present invention.
Figure 1B:
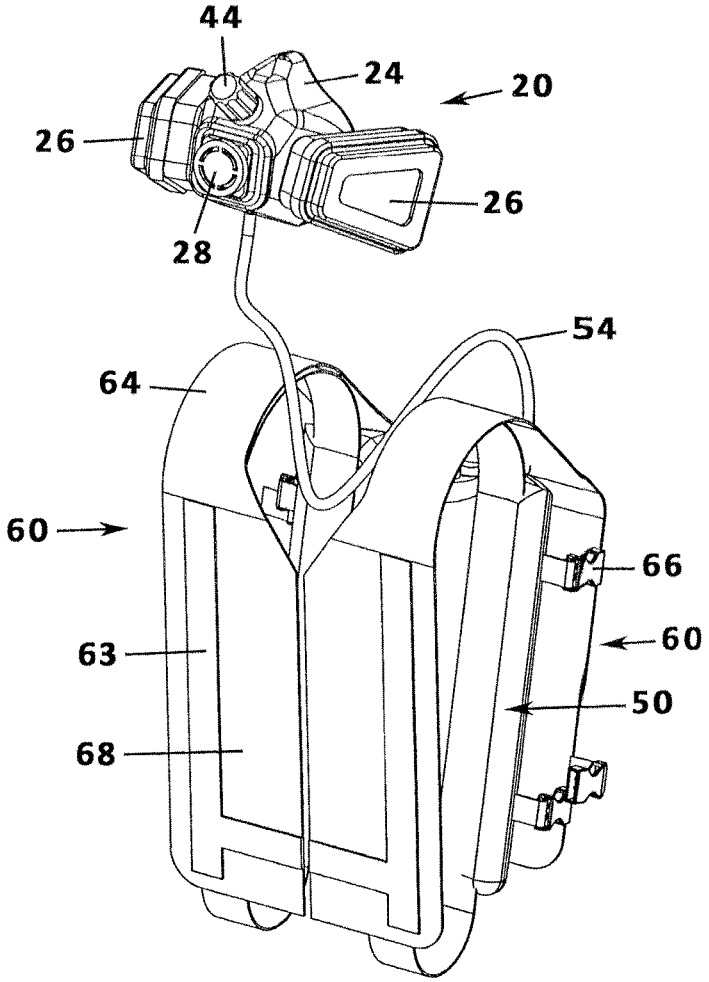
FIG. 1*b* is front perspective view of the hydration respiration apparatus as in FIG. 1*a* with a safety vest coupled to respective front straps of the backpack.
Figure 1C:
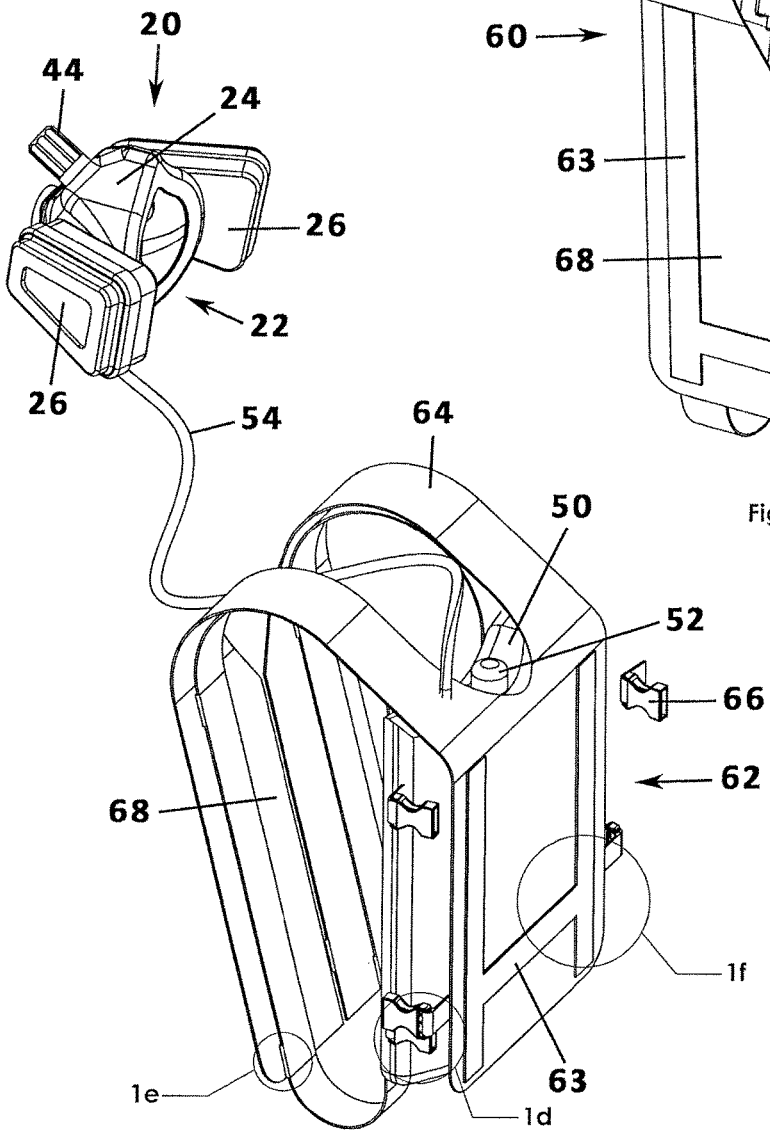
FIG. 1*c* is a rear perspective view of the hydration respiration apparatus as in FIG. 1*b;*
Figure 1D:
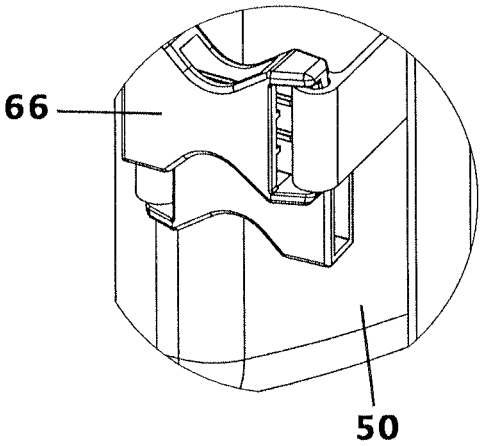
FIG. 1*d* is an isolated view on an enlarged scale taken from FIG. 1*c;*
Figure 1E:
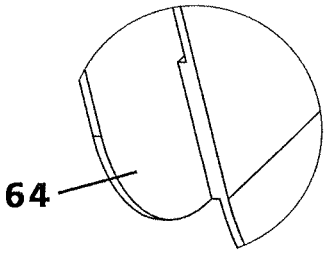
FIG. 1*e* is an isolated view on an enlarged scale taken from FIG. 1*c;*
Figure 1F:
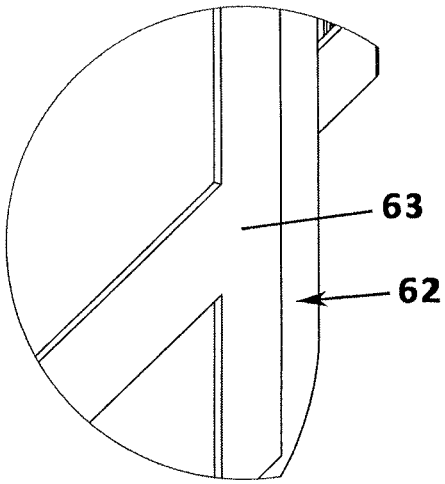
FIG. 1*f* is an isolated view on an enlarged scale taken from FIG. 1*c;*
Figure 2A:
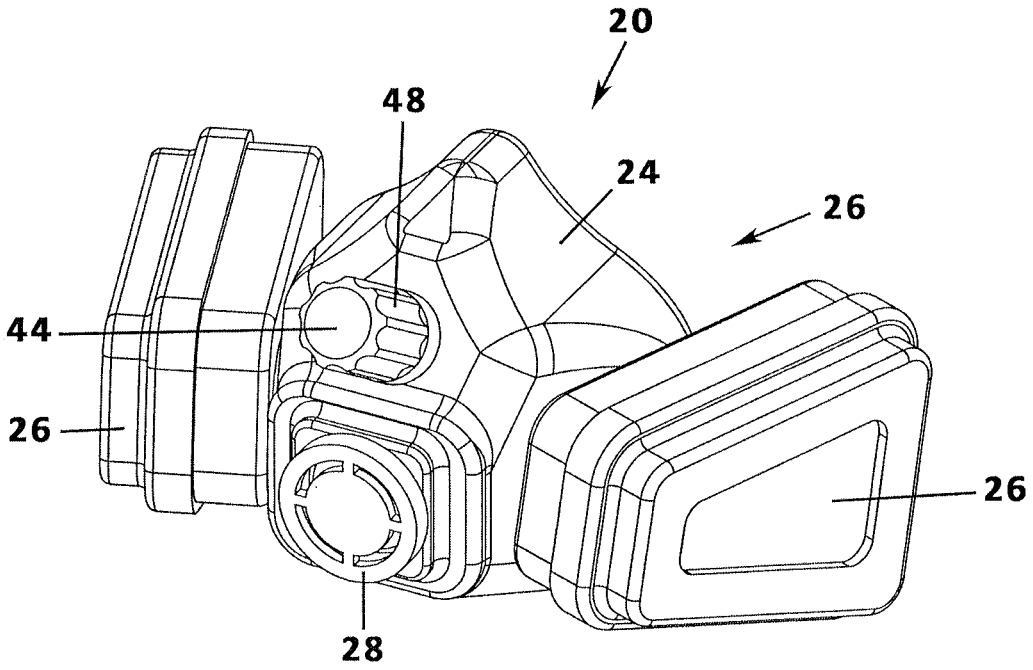
FIG. 2*a* is a perspective of a respirator assembly removed from the hydration assembly as in FIG. 1*a;*
Figure 3A:
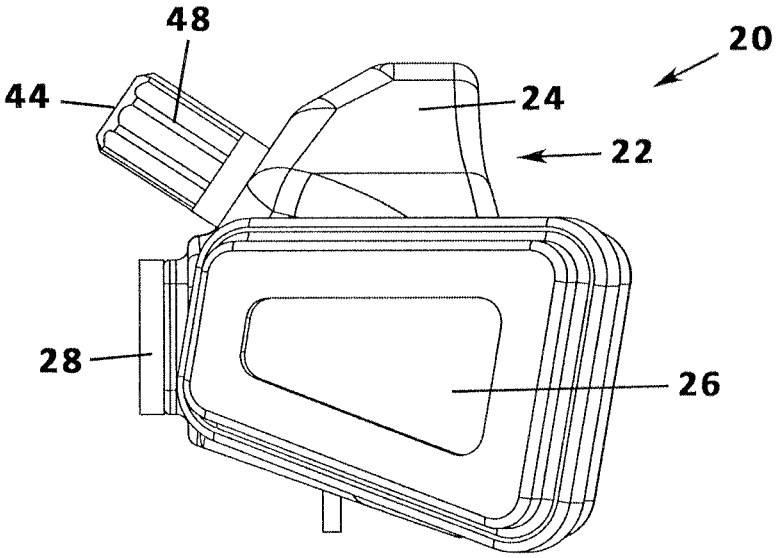
FIG. 3*a* is a side view of the respirator assembly as in FIG. 2*a;*
Figure 3B:
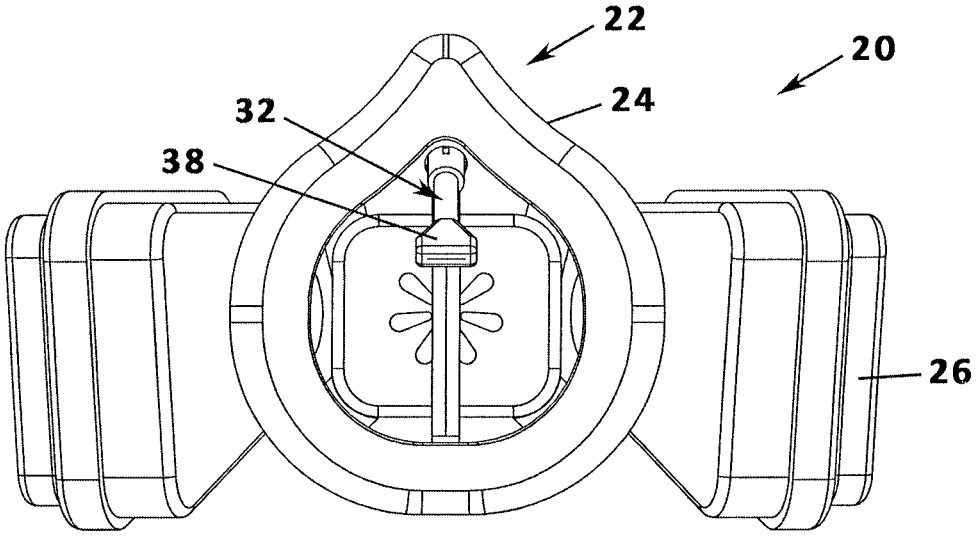
FIG. 3*b* is a rear view of the respirator assembly as in FIG. 2*a;*

A hydration respiration apparatus for providing clean air and water to a user according to a preferred embodiment of the present invention will now be described with reference to FIGS. 1 to 6*c* of the accompanying drawings. The hydration respiration apparatus 10 includes a respirator assembly 20 having a facemask 22, a hydration assembly 30 having a hydration tube 32 and hydration reservoir 50 and a backpack 60 configured to carry the hydration reservoir 50 in proximity to the hydration tube 32.

The respirator assembly 20 includes a facemask 22 having a body portion 24 and a pair of opposed filter cartridges 48 coupled to opposed sides of the body portion 24. The body portion 24 of the facemask 22 has a front surface that defines an interior area therebeneath. The facemask 22 is configured to cover at least the nose and mouth of a user who wears the facemask 22 on his face. It is understood that the facemask 22 of the respirator assembly 20 may include face straps configured for attachment of the facemask 22 to a user's head (not shown). Each filter cartridge 26 is constructed and configured so as to intercept particulate impurities and to keep them from entering the interior area. The facemask 22 may include an exhale port 28 that defines an opening that enables a user wearing the facemask 22 to exhale and for the exhaled air to exit the interior area.

Figure 5A:
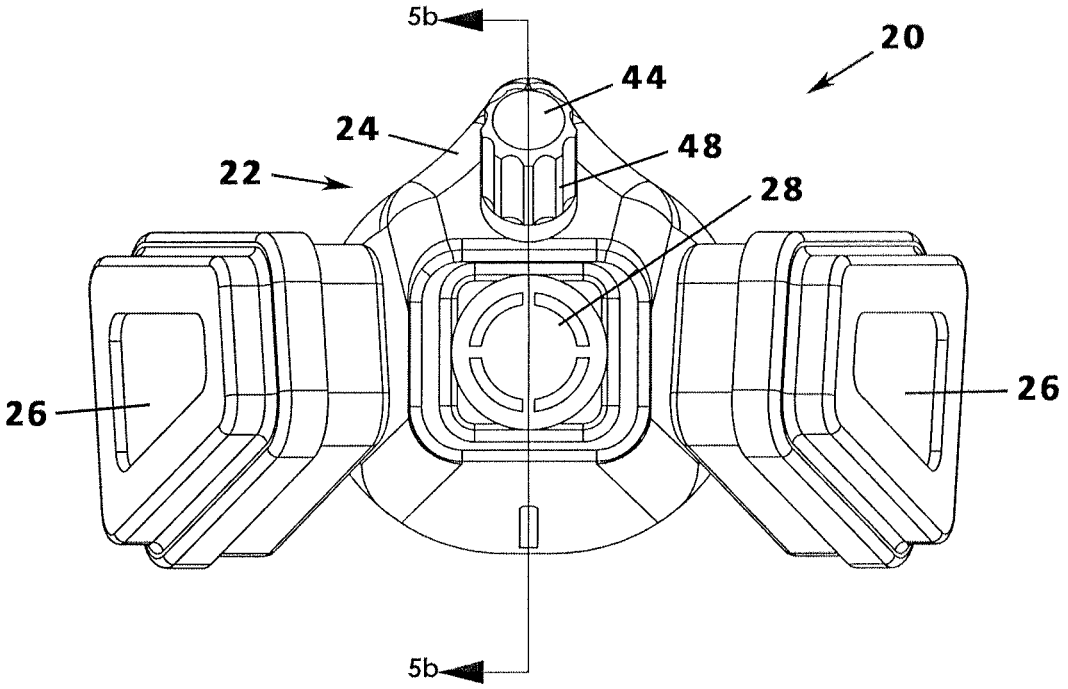
FIG. 5*a* is a front view of the respirator assembly as in FIG. 2*a;*
Figure 5B:
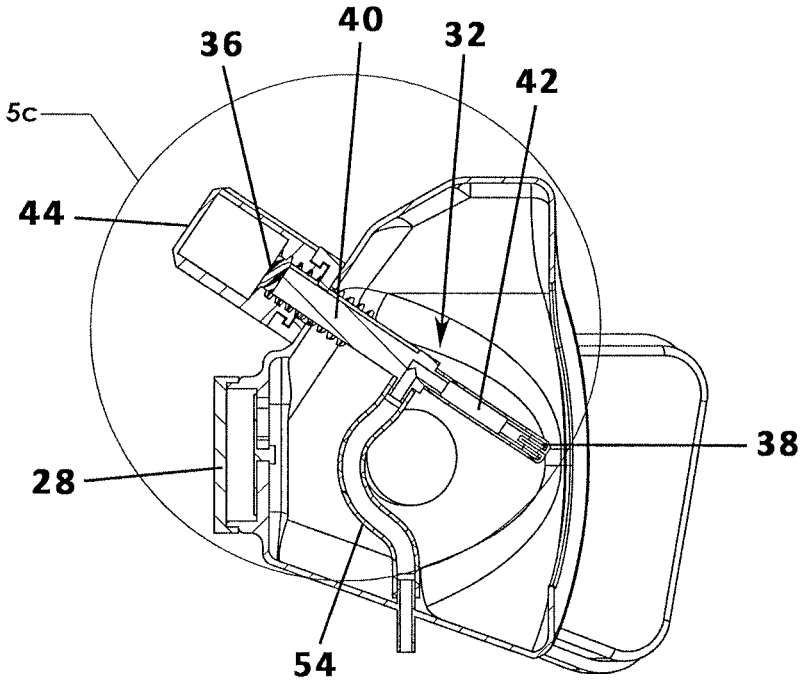
FIG. 5*b* is a sectional view taken along line 5*b*-5*b* of FIG. 5*a*, illustrating the hydration tube in a deployed configuration.
Figure 5C:
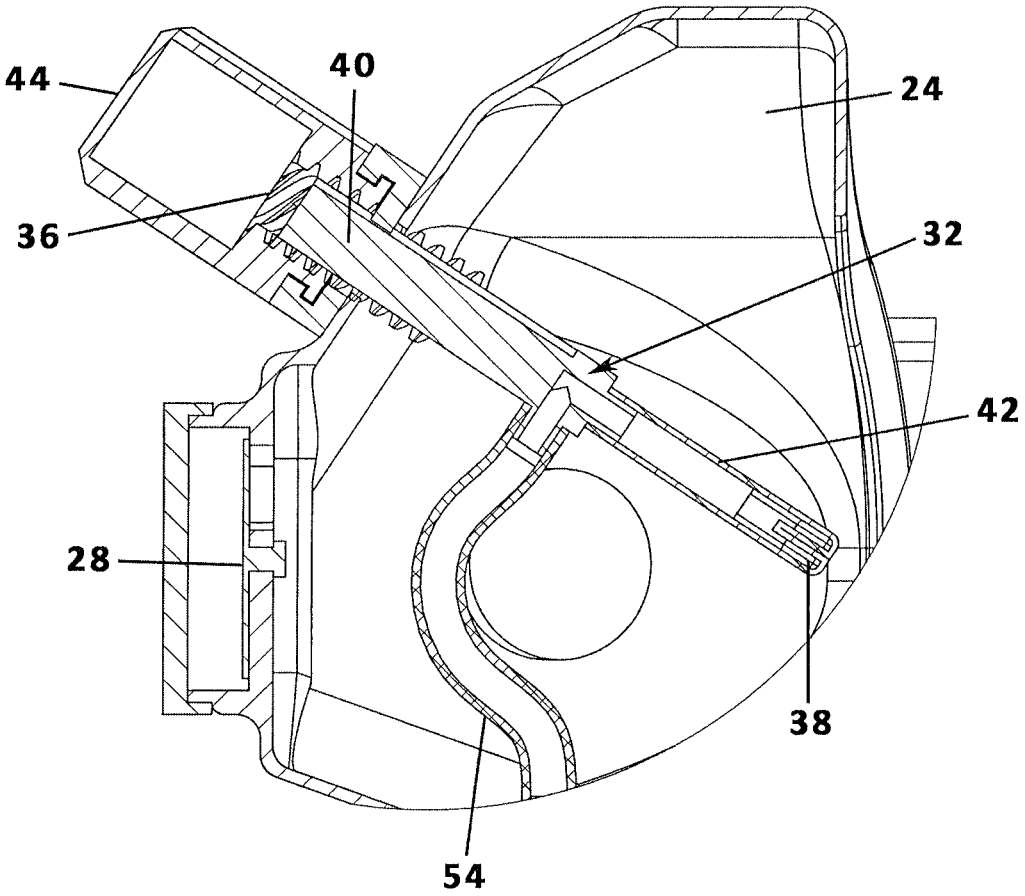
FIG. 5*c* is an isolated view on an enlarged scale taken from FIG. 5*b;*
Figure 6A:
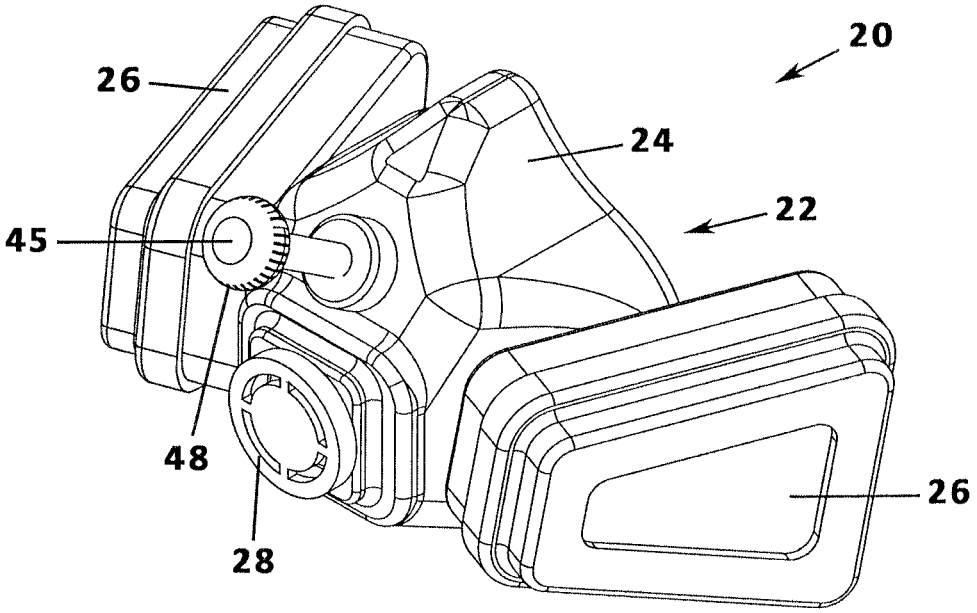
FIG. 6*a* is another perspective of a respirator assembly according to another embodiment of the present invention.
Figure 6B:
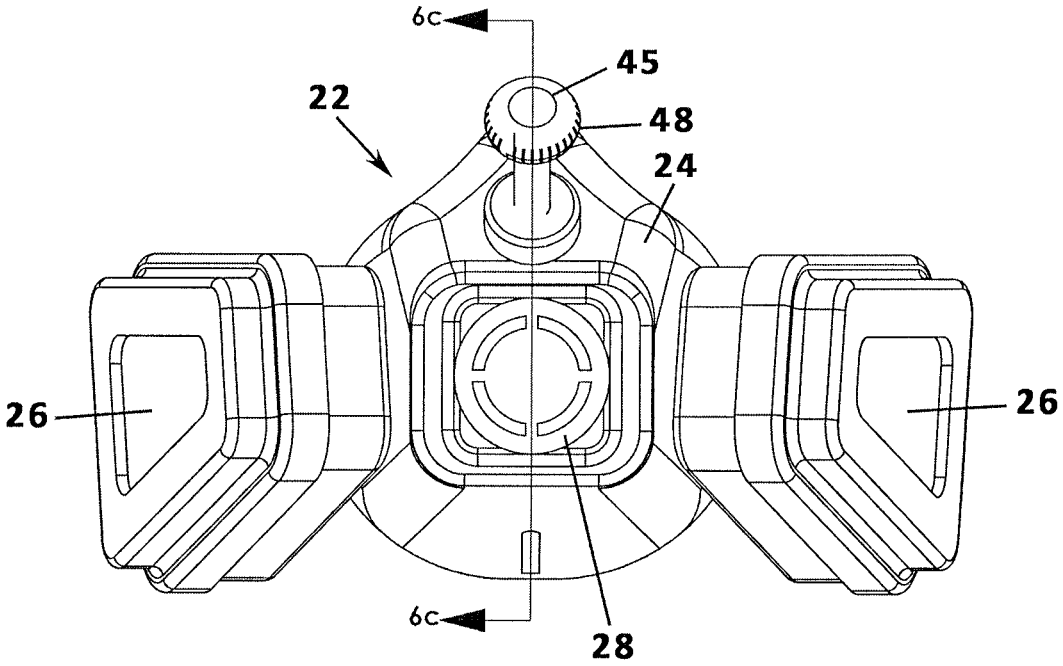
FIG. 6*b* is a front view of the respirator assembly as in FIG. 6*a*.
Figure 6C:
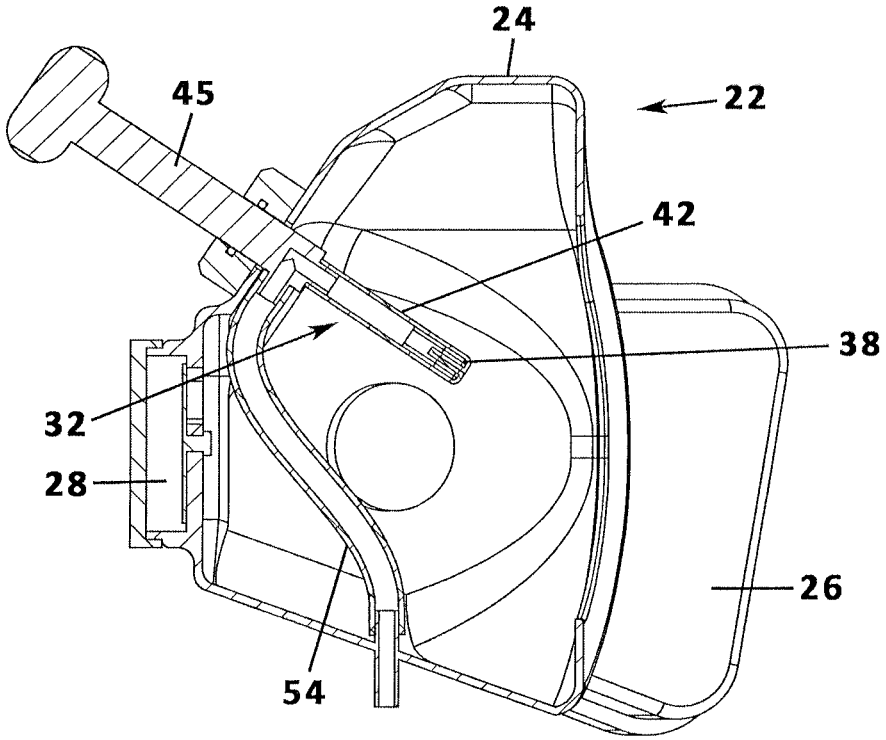
FIG. 6*c* is a sectional view taken along line 6*c*-6*c* of FIG. 6*b*.

The hydration assembly 30 includes a hydration tube 32 and a hydration reservoir 50 in fluid communication with the hydration tube 32. More particularly, the hydration tube 32 has a generally linear configuration and extends through a hole in the front surface of the facemask 22. The hydration tube 32 includes a proximal end 34 normally situated in the interior area of the facemask 22 and a distal end 36 displaced from or extending away from the front surface of the facemask 22. Preferably, the facemask 22 defines a hole through which the hydration tube 32 is inserted. In an embodiment, the hydration tube 32 is slidably movable in back and forth movement through the hole in the facemask 22 between a retracted configuration substantially outside the interior area (FIG. 4*c*) and a deployed configuration substantially inside the interior area (FIG. 5*c*). A bite valve 38 is positioned at the proximal end of the hydration tube 32, the bite valve being configured to dispense water from the supply hose into the hydration tube when the bite valve is bitten by a user.

The hydration reservoir 50 is configured to contain a volume of a liquid, such as water, the hydration reservoir 50 having an inlet port 52 that receives a water transfer member, such as a hose, configured to refill the reservoir 50. The hydration reservoir 50, therefore, is refillable via the inlet port 52. The hydration reservoir 50 is displaced from the hydration tube 32 (such as being coupled to a backpack 60 as will be described later) but is in fluid communication therewith via a supply hose 54. The supply hose 54 is configured to keep said hydration tube 32 filled with liquid from the hydration reservoir 50.

Figure 4A:
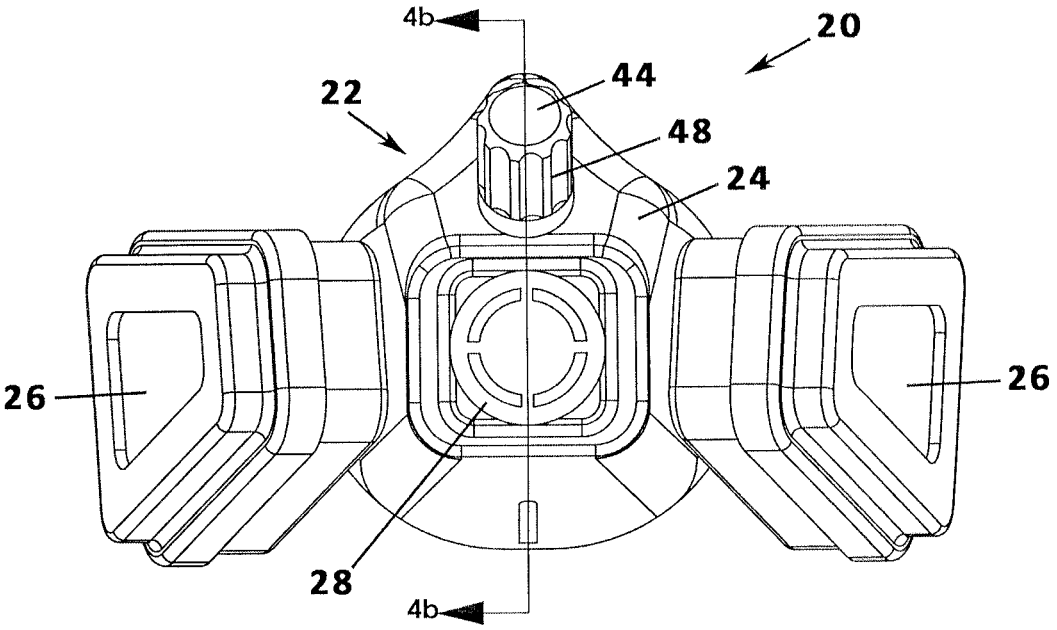
FIG. 4*a* is a front view of the respirator assembly as in FIG. 2*a;*
Figure 4B:
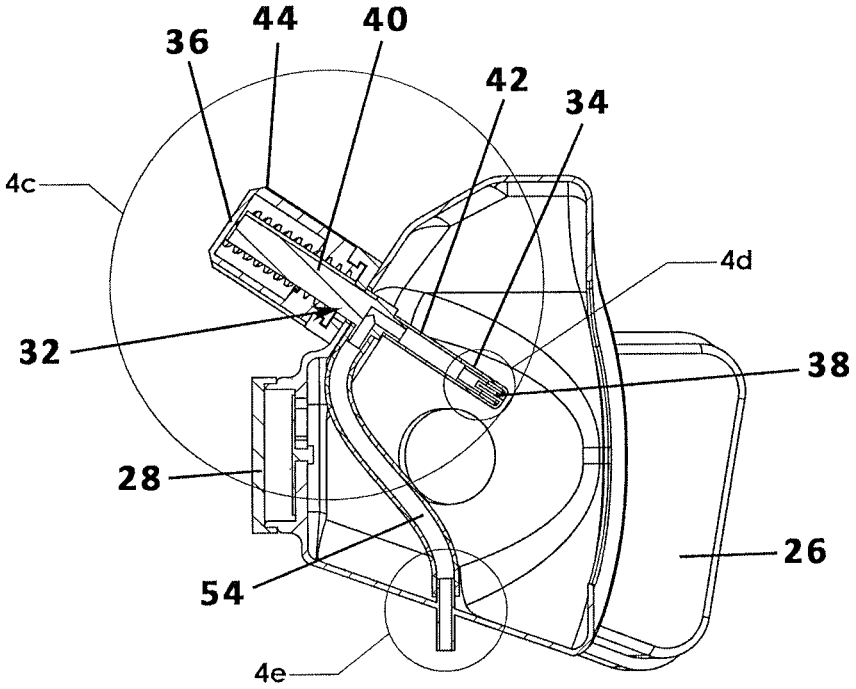
FIG. 4*b* is a sectional view taken along line 4*b*-4*b* of FIG. 4*a*, illustrating the insertion tube in a retracted configuration.
Figure 4C:
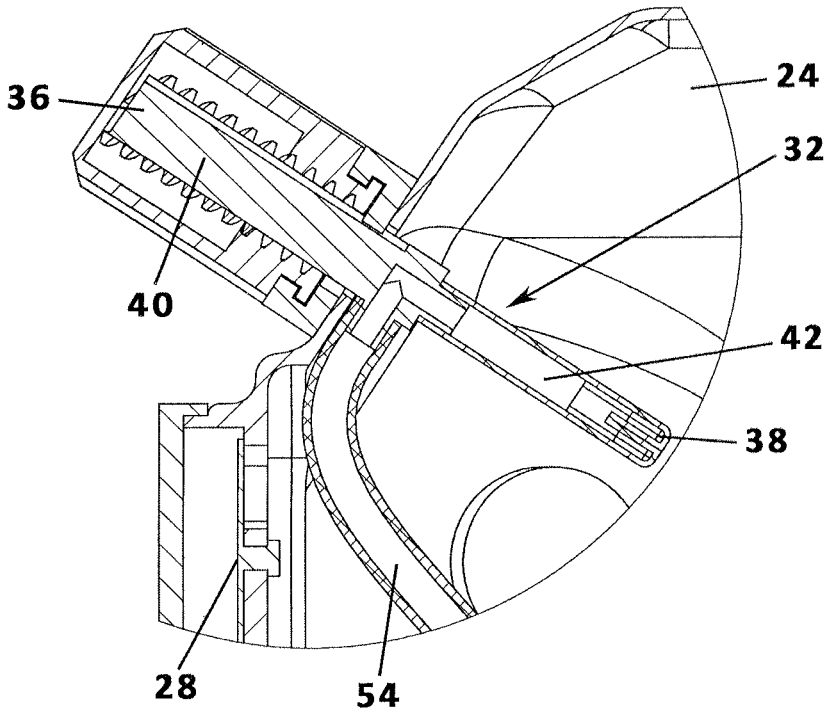
FIG. 4*c* is an isolated view on an enlarged scale taken from FIG. 4*b;*
Figure 4D:
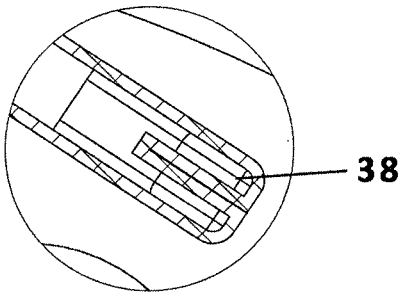
FIG. 4*d* is an isolated view on an enlarged scale taken from FIG. 4*b;*
Figure 4E:
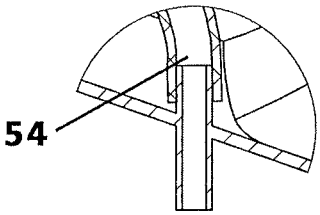
FIG. 4*e* is an isolated view on an enlarged scale taken from FIG. 4*b;*

The proximal end 34 of the hydration tube 32 includes a bite valve 38 configured to selectively allow liquid, such as water, to pass through it when the hydration tube 32 is at the deployed configuration and a user bites down on the bite valve 38 with his teeth. The hydration tube 32 includes an outer portion 40 situated outside of the facemask 22 extending away from the hole and an inner portion 42 situated in the interior area extending inwardly from the hole. In an embodiment, the outer portion 40 includes a plurality of threads along its outer surface (FIGS. 4*b* and 5).

The hydration assembly 30 includes an actuator operatively coupled to a distal end of the outer portion 40 of the hydration tube 32 and is configured to actuate movement of the hydration tube 32 in and out of the interior area of the facemask. In an embodiment, the actuator may be a knob 44 having a plurality of threads complementary to and engaged with the threads along the outer portion 40 of the hydration tube 32 such that a rotation of the knob 44 causes the hydration tube 32 to be moved between a deployed configuration in which the outer portion 40 (FIG. 5*c*) is outside the inner portion 42 and a retracted configuration in which the outer portion 40 is substantially outside of the interior area (FIG. 4*c*) when twisted in clockwise and counterclockwise directions, respectively. The outer portion 40 is coupled to the inner portion 42 so as to push the inner portion 42 further into the interior area or to pull the inner portion 42 out of the interior area when the knob 44 is twisted. At the deployed configuration, the bite valve 38 is positioned proximate a user's mouth when the facemask 22 is strapped to the user's head.

In another embodiment, the actuator may be a linear actuator 45 that includes a shaft having a generally linear configuration slidably coupled to the front wall of said facemask 22 and aligned to move through the hole in the facemask 22. The shaft 46 includes an inner end operatively coupled to a distal end of the hydration tube 32 and is configured to urge the hydration tube 32 between the deployed and retracted configurations described above. In use, a user may simply push the linear actuator 45 (i.e. the shaft) to move the bite valve 38 into the mouth of the user and, conversely, pull on the linear actuator 45 to retract the bite valve away from the user's mouth.

In either embodiment described above, the knob 44 actuator or the linear actuator 45 include means for enhancing the grip of a user to turn or push it, respectively. For instance, each actuator may include a plurality of ridges 48, surface dimples, or other elements that enhance the dexterity of a user gripping the actuator to then move the hydration tube 32 between retracted and deployed positions.

In another aspect, the hydration respiration apparatus 10 includes a backpack 60 having a back portion 62 and a pair of front straps 64 coupled to and extending from the back portion 62. The front straps 64 are spaced apart from one another and are configured to be worn over the shoulders of a user in the manner of a traditional backpack. One or more fasteners 66, such as quick connect or snap fit buckles, are coupled to the back portion 62 that are selectively and releasably coupled to the hydration reservoir 50. In other words, the hydration reservoir 50 may be worn on the back of a user when coupled to the back portion 62 and the front straps 64 of the backpack 60 are worn on a user's shoulders.

The backpack 60 is characterized by additional features. More particularly, the back portion 62 may include at least one reflective strip 63 that is configured to reflect light so that a user wearing the backpack 60 is more visible. This is a safety feature that is even more important if a worker wearing the backpack 60 in an industrial area where forklifts, trucks, or other machinery is present.

Further, a safety vest 68 may be coupled to a front surface of the front straps 64 of the backpack 60 (FIG. 1*a*), the safety vest 68 being constructed of a mesh or thin plastic material so as to shield the front of a user from dirt, paint overspray, or other undesirable elements he may encounter while working. The safety vest 68 may also include a reflective strip 63. In an embodiment, safety vest 68 may be removably attached to the front straps 64 with corresponding hook and loop fastener combinations or similar fasteners.

In use, the hydration reservoir 50 may be filled with drinking water via the inlet port 52 and the hydration reservoir is attached to the back portion 62 of the backpack 60 via the fasteners 66. The front straps 64 may be slipped over a user's shoulders so that the backpack 60 may be carried on a user's penetration, The facemask 22 of the respiration assembly 20 may be strapped to a user's face. Then, when the user desires a drink of water, he may move the hydration tube 32 toward the deployed configuration as described above and bite down on the bite valve 38 such that water is dispensed into the user's mouth. When finished, the user may reverse movement of the hydration tube to the retracted configuration. Accordingly, the user is able to maintain hydration without ever removing the entire facemask 22 from his head.

It is understood that while certain forms of this invention have been illustrated and described, it is not limited thereto except insofar as such limitations are included in the following claims and allowable functional equivalents thereof.

The invention claimed is:

1. A hydration respiration apparatus for providing clean air and water to a user, comprising:

a respirator assembly that includes a facemask defining an interior area and configured to cover at least the nose and mouth of user and a pair of filter cartridges situated on opposed sides of said facemask in communication with said interior area; and a hydration assembly that includes a hydration tube extending through a front wall of said facemask and a hydration reservoir that is configured to hold a liquid, the hydration reservoir being displaced from said respirator assembly and in fluid communication with said hydration tube by means of a supply hose;

wherein said supply hose is configured to connect to the hydration tube at a location within the interior area, between a distal end of the hydration tube and a proximal end of the hydration tube;

wherein said proximal end of the hydration tube is situated in said interior area of said facemask and said distal end is situated outside said facemask, said hydration tube being selectively movable between a retracted configuration substantially outside said interior area and a deployed configuration substantially inside said interior area;

wherein said proximal end of said hydration tube includes a valve configured to selectively release water into the mouth of the user when said hydration tube is at said deployed configuration.

2. The hydration respiration apparatus as in claim 1, wherein said hydration assembly includes an actuator coupled to said hydration tube, said actuator being configured to selectively and incrementally move said hydration tube between said retracted and deployed configurations.

3. The hydration respiration apparatus as in claim 2, wherein said actuator is a knob threadably coupled to an outer portion of said hydration tube, said knob configured to move said hydration tube between said deployed and retracted configurations when twisted in clockwise and counterclockwise directions, respectively.

4. The hydration respiration apparatus as in claim 3, wherein said knob includes a plurality of ridges configured to enhance the grip of a user's hand.

5. The hydration respiration apparatus as in claim 2, wherein said actuator is a shaft having a generally linear configuration slidably coupled to said front wall of said facemask and having an inner end coupled to said distal end of said hydration tube, said shaft being configured to move said hydration tube between said deployed and retracted configurations when urged in and out of said facemask, respectively.

6. The hydration respiration apparatus as in claim 5, further comprising a backpack that includes a back portion having fasteners selectively coupled to said hydration reservoir and a pair of front straps extending from said back portion, said pair of front straps configured to be worn over the shoulders of the user.

7. The hydration respiration apparatus as in claim 2, wherein said actuator includes a plurality of ridges configured to enhance the grip of a user's hand.

8. The hydration respiration apparatus as in claim 2, wherein said hydration reservoir is refillable.

9. The hydration respiration apparatus as in claim 1, wherein said valve includes a bite valve that is configured to allow liquid to pass therethrough when the user bites on it.

10. The hydration respiration apparatus as in claim 9, wherein said supply hose extends between said reservoir and said hydration tube, said supply hose being configured to keep said hydration tube filled with liquid from said reservoir such that liquid is available on demand when a user bites on said bite valve.

11. The hydration respiration apparatus as in claim 1, wherein said supply hose extends between said reservoir and said hydration tube, said supply hose being configured to keep said hydration tube filled with liquid from said reservoir.

12. The hydration respiration apparatus as in claim 1, wherein said facemask includes an exhale port configured to selectively exhaust the user's breath from the interior area of said facemask.

13. The hydration respiration apparatus as in claim 1, wherein each filter cartridge is configured to intercept particulate impurities from entering said interior area.

14. The hydration respiration apparatus as in claim 1, further comprising a backpack that includes a back portion having fasteners selectively coupled to said hydration reservoir and a pair of front straps extending from said back portion, said pair of front straps configured to be worn over the shoulders of the user.

15. The hydration respiration apparatus as in claim 14, wherein said back portion includes at least one reflective surface that is configured to reflect light.

16. The hydration respiration apparatus as in claim 14, further comprising a safety vest situated on said front straps.

17. The hydration respiration apparatus as in claim 16, wherein said safety vest is removably coupled to said front straps.

18. A hydration respiration apparatus for providing clean air and water to a user, comprising:

a respirator assembly that includes a facemask having a front surface and defining an interior area, said facemask configured to cover at least the nose and mouth of user and having a pair of filter cartridges situated on opposed sides of said facemask in communication with said interior area; and a hydration assembly that includes a hydration tube extending through a front wall of said facemask and a hydration reservoir that is configured to hold a liquid, said hydration reservoir being displaced from said respirator assembly and in fluid communication with said hydration tube by means of a supply hose;

wherein said supply hose is configured to connect to the hydration tube at a location within the interior area, between a distal end of the hydration tube and a proximal end of the hydration tube;

wherein said proximal end of the hydration tube is situated in said interior area of said facemask and said distal end is situated outside said facemask, said hydration tube being selectively movable between a retracted configuration substantially outside said interior area and a deployed configuration substantially inside said interior area;

wherein said proximal end of said hydration tube includes a bite valve that is configured to selectively allow liquid to pass therethrough when said hydration tube is at said deployed configuration and the user bites on said bite valve;

wherein said hydration assembly includes an actuator operatively coupled to said front wall of said facemask and coupled to said hydration tube, said actuator being configured to move said hydration tube between said retracted and deployed configurations.

19. The hydration respiration apparatus as in claim 18, wherein said actuator is a knob threadably coupled to an outer portion of said hydration tube, said knob configured to move said hydration tube between said deployed and retracted configurations when twisted in clockwise and counterclockwise directions, respectively.

20. The hydration respiration apparatus as in claim 18, wherein said actuator is a knob having a linear configuration slidably coupled to said front wall of said facemask and having a inner end coupled to said distal end of said hydration tube, said knob being configured to move said hydration tube between said deployed and retracted configurations when urged towards and away from of said facemask, respectively.

21. The hydration respiration apparatus as in claim 18, further comprising a backpack that includes a back portion having fasteners selectively coupled to said hydration reservoir and a pair of front straps extending from said back portion, said pair of front straps configured to be worn over the shoulders of the user.

* * * * *